United States Patent [19]

Amberg et al.

[11] Patent Number: 4,889,644

[45] Date of Patent: Dec. 26, 1989

[54] MACHINE WASHING PROCESS: DETERGENT PASTE AND AUTOMATIC DISPENSER

[75] Inventors: Güenther Amberg, Neuss; Wolfgang Bechstedt, Langenfeld; Paul Schulz, Wuppertal; Uwe Trabitzsch, Ratingen, all of Fed. Rep. of Germany

[73] Assignee: Henkel Kommanditgesellschaft auf Aktien, Duesseldorf, Fed. Rep. of Germany

[21] Appl. No.: 207,610

[22] Filed: Jun. 15, 1988

[30] Foreign Application Priority Data

Jun. 15, 1987 [DE] Fed. Rep. of Germany ..... 3719906

[51] Int. Cl.[4] ..... D66L 1/12; C11D 17/08

[52] U.S. Cl. ..... 252/8.9; 8/137; 134/56 R; 134/93; 134/201; 252/8.7; 252/170; 252/174.21; 252/DIG. 1

[58] Field of Search ..... 8/137; 252/8.9, 174.21

[56] References Cited

U.S. PATENT DOCUMENTS 4,144,226 3/1979 Crutchfield et al. ..... 528/231

4,146,495 3/1979 Crutchfield et al. ..... 252/89

FOREIGN PATENT DOCUMENTS 0025551 9/1982 European Pat. Off. .

*Primary Examiner*—A. Lionel Clingman

*Attorney, Agent, or Firm*—Ernest G. Szoke; Wayne C. Jaeschke; Real J. Grandmaison

[57] ABSTRACT

A machine washing process with process-controlled dosing of water and detergent using a paste-form, phosphate-reduced or phosphate-free detergent which is substantially free from water, organic solvents and hydrotropic compounds. The paste comprises a phase liquid at a temperature below 10° C. and contains a nonionic surfactant selected from the group of polyglycolether compounds and of a solid phase dispersed therein in which the particles have a mean particle size of from 5 to 40 μm and less than 5% of the particles have a particle size larger than 80 μm, the solid phase comprising washing alkalis, sequestering compounds and other detergent constituents and, optionally, anionic surfactants. Under the control of a process-control computer, the paste is taken from a storage container, delivered to a mixer and diluted therein with water to at least such an extent that the formation of a gel phase is avoided. The aqueous mixture is fed to a washing machine and, unless this has already happened in the mixer, is diluted with more water to a concentration of 0.5 to 10 g/l, after which the washing process is started.

21 Claims, 4 Drawing Sheets

MACHINE WASHING PROCESS: DETERGENT PASTE AND AUTOMATIC DISPENSER

BACKGROUND OF THE INVENTION

1. Field of the Invention

This invention relates to a washing process which is particularly suitable for institutional laundries and which is based on the development of a new, paste-form detergent composition which is fed into the washing process by means of a dosing system designed specifically for this detergent.

2. Discussion of Related Art

There are many know liquid to paste-form detergents. They are generally designed to meet domestic requirements, i.e., are intended to be sufficiently liquid so that they may be poured out and dispensed without difficulty. Since, in addition, they are required to be stable in storage over a relatively wide temperature range, it is normally necessary that they contain organic solvents and/or hydrotropic additives. However, such additives are inactive in the washing process, are comparatively expensive and also occupy packaging volume, storage and transport capacity. Above all, the presence of inflammable solvents is problematical, necessitating additional safety precautions on account of the comparatively high throughput of detergents in laundries. Accordingly, detergent concentrates of the type mentioned are suitable to only a limited extent, if at all, for laundries.

Because of this, powder-form detergents are mainly used in laundries. Since the exact dosing of detergents such as these is problematical of laborious, particularly in large, substantially automated laundries, the detergents are mostly stored and dosed or dispensed in predissolved form as stock liquors, i.e., an aqueous concentrate is prepared and then fed to the individual points of use. However, the detergents normally used in laundries contain comparatively large amounts of washing alkalis which possess only limited solubility in cold water and, in addition, produce salting-out effects. They cause phase separation with the result that the organic components, particularly the nonionic surfactants and soaps, separate and cream up. Accordingly, relatively high dilution in water is necessary, in addition to which the stock liquors have to be continuously intensively mixed and circulated to prevent individual components from settling in the feed lines to the points of use. Accordingly, processes of the type herein involve heavy expenditure for large mixing vessels and the associated controls and for mixers and feeders and also a constant power supply for thermostatic control and pumping of the stock liquors.

Accordingly, there is a considerable need for detergent compositions and corresponding dosing systems by which the problems mentioned above are avoided and which satisfy the following requirements: high detergency; absence of washing-inactive additives which merely serve to condition the detergent; minimal occupation of packaging, transport and storage volume; ready processibility, even at low temperatures (supercooled pastes); simple connection to the dosing system with no spilling; simple and compact dosing system; suitability of the dosing system for fully automatic process control; wide variability in regard to the choice of the quantity and concentration of detergent; immunity to problems caused by phase separation and sedimentation in containers and pipes; and minimal energy demand.

These requirements are met by the present invention.

DESCRIPTION OF THE INVENTION

Other than in the operating examples, or where otherwise indicated, all numbers expressing quantities of ingredients or reaction conditions used herein are to be understood as modified in all instances by the term "about".

The present invention relates to a machine washing process with process-controlled dosing of water and detergent, comprising:

(a) a paste-form, phosphate-reduced or phosphate-free detergent composition which is substantially free from water, organic solvent and hydrotropic compound, comprising a phase which is liquid at a temperature below 10° C. and containing a nonionic surfactant selected from the group consisting of polyglycolether compounds, and a solid phase dispersed therein wherein the particles have a mean particle size of about 5 to about 40 μm and less than about 5% of the particles have a particle size of greater than about 80 μm, the solid phase comprising a washing alkali, sequestering compound and other detergent constituents; and (b) a process-controlled system for dosing said detergent composition into the liquor container of a washing machine, said system removing said detergent composition from a storage container and delivering it to a mixer wherein it is diluted with water to at least such an extent that the formation of a gel phase is avoided, feeding the aqueous detergent mixture to the washing machine, and diluting the aqueous detergent mixture with more water to a concentration of 0.5 to 10 g/l.

The individual features of the invention will now be described.

The detergent composition comprises a paste which is substantially free from water and organic solvents. By "substantially free from water" is meant a condition in which the content of liquid water, i.e., water which is not present in the form of water of hydration and water of crystallization, is below 2% by weight, preferably below 1% by weight and more preferably below 0.5% by weight, based on the weight of the detergent composition. Higher water contents are unfavorable because they increase the viscosity of the detergent over-proportionally and reduce its stability. Organic solvents, including the low molecular weight, low-boiling alcohols and ether alcohols normally used in liquid concentrates, are also absent apart from traces which may be introduced with individual ingredients.

The detergent comprises a liquid phase and a finely divided solid phase dispersed therein.

The liquid phase consists essentially of a nonionic surfactant melting at a temperature of less than 10° C. or mixtures thereof. It is preferred to use a surfactant or mixture of surfactants whose solidification point is below 5° C. so as to avoid solidification of the paste at relatively low transport and storage temperatures. Suitable such surfactants include alkoxylated alcohols which may be linear or methyl-branched in the 2-position (oxo alcohols) and contain 9 to 16 carbon atoms and 2 to 10 ethylene glycol ether groups. Alkoxylates containing both ethylene oxide (EO) groups and propylene glycol ether (PO) groups are also suitable by virtue of their low solidification point. Additional suitable surfactants include $C_9$–$C_{11}$ oxo alcohols containing 2 to 10 EO, such as $C_9$–$C_{11}$+3 EO, $C_9$–$C_{11}$+5 EO, $C_9-C_{11}+7$ EO, $C_9-C_{11}+9$ EO; $C_{11}-C_{13}$ oxo alcohols containing 2 to 8 EO, such as $C_{11}-C_{13}+2$ EO, $C_{11}-C_{13}+5$ EO, $C_{11}-C_{13}+6$ EO, $C_{11}-C_{13}+7$ EO; $C_{12}-C_{15}$ oxo alcohol+3-6 EO, such as $C_{12}-C_{15}+3$ EO, $C_{12}-C_{15}+5$ EO; isotridecanol containing 3 to 8 EO; linear fatty alcohols containing 10 to 14 carbon atoms and 2.5 to 5 EO; linear or branched $C_9-C_{14}$ alcohols containing 3 to 8 EO and 1 to 3 PO, such as $C_9-C_{11}$ oxo alcohol+$(EO)_4(PO)_{1-2}(EO)_4$ or $C_{11}-C_{13}$ oxo alcohol+$(EO)_{3-10}(PO)_{1-5}$ with statistically distributed alkoxyl groups; linear, saturated and unsaturated $C_{12}-C_{18}$ fatty alcohols or $C_9-C_{15}$ oxo alcohols containing 1 to 3 PO and 4 to 8 EO, such as $C_{12}-C_{18}$ coconut alcohol+$(PO)_{1-2}(EO)_{4-7}$, oleyl alcohol or a 1:1 mixture of cetyl and oleyl alcohol+$(PO)_{1-2}(EO)_{5-7}$, $C_{11}-C_{15}$ oxo alcohol+$(PO)_{1-2}(EO)_{4-6}$.

Ethoxylated alcohols wherein the terminal hydroxyl groups are alkylated by lower alkyl groups are also suitable for the purposes of the invention by virtue of their low solidification point, for example a $C_{10}-C_{14}$ alcohol containing 3 to 10 EO groups and a terminal methoxyl group. Other suitable nonionic surfactants include EO-PO-EO block polymers having a correspondingly low solidification point and ethoxylated alkylphenols, such as nonylphenol containing 7 to 10 EO. However, these particular surfactants may be excluded from use in certain fields on account of their reduced biological degradability. Because of this, they are less preferred.

The content of the aforementioned nonionic surfactants in the pastes should be gauged in such a way that, on the one hand, the pastes are still sufficiently fluid and pumpable, but on the other hand are not so free-flowing that they are in danger of separating. Suitable pastes contain 15 to 30% by weight, based on the weight of the detergent composition, preferably 18 to 28% by weight and more preferably 20 to 25% by weight of a liquid nonionic surfactant having a low solidification point (below 5° C.). Where surfactants having a relatively high solidification point, for example from 5 to 20° C., are used in admixture with particularly low-melting surfactants, the minimum content is somewhat higher, for example on the order of 18% by weight and preferably from 22 24% by weight, the maximum content being less than 35% by weight and preferably 30% by weight, based on the weight of the detergent composition.

In particular cases, a single nonionic surfactant may itself have the desired qualifications, i.e., a low solidification point, favorable flow behavior, high detergency and low foam generation. One example of such a surfactant is oleyl alcohol or a mixture rich in oleyl alcohol which has been reacted first with 1 to 2 PO and then with 5 to 7 PO. However, particularly favorable properties are often obtained with mixtures of nonionic surfactants differing in their degrees of ethoxylation and, optionally, their carbon chain lengths. Accordingly, mixtures of nonionic surfactants having a low degree of ethoxylation and a low solidification point, for example $C_9-C_{15}$ alcohols containing 2 to 5 EO, and those having a relatively high degree of ethoxylation and a relatively high solidification point, for example $C_{11}-C_{15}$ alcohols containing 5 to 7 EO, are particularly preferred. The weight ratio between the two alcohol ethoxylates in the mixture is governed both by the washing requirements and by the flow behavior of the detergent paste and is generally between 15:1 and 1:3 and preferably between 8:1 and 1:1. Examples of such mixtures include a mixture of 2 parts by weight $C_9-C_{11}$ oxo alcohol containing 2.5 EO and 1 part by weight $C_{11}-C_{13}$ oxo alcohol+7 EO; a mixture of 3 parts by weight of a $C_{11}-C_{14}$ oxo alcohol containing 3 EO and 2 parts by weight of a $C_9-C_{13}$ oxo alcohol containing 8 EO; and a mixture of 7 parts by weight $C_{13}$ oxo alcohol containing 3 EO and 1 part by weight of the same alcohol containing 6 EO.

Finally, the flow properties of the pastes may be modified by the addition of a polyethyleneglycol having a low molecular weight (for example 200 to 800). It may be added in a quantity of, for example, less than 15% by weight. However, the contribution of these additives, which in many cases are also included among the nonionic surfactants, to the detergency is comparatively small although they can have a foam-inhibiting effect and, for this reason, are desirable. They are preferably added in a quantity of less than 10% by weight, and more preferably in a quantity of from 0.5 to 8% by weight, based on the weight of the detergent composition.

The polyglycol may also be completely or partly replaced by a paraffin oil or liquid paraffin mixtures which, although making no contribution to detergency, make the paste easier to process, particularly during the grinding of the ingredients, and reduce foaming considerably, which is particularly advantageous in the final rinse. The content of such paraffin oils or paraffin oil mixtures is preferably less than 8% by weight, and more preferably less than 6% by weight of the detergent composition. Liquid longchain ethers may also be used in the same quantity for the same purpose, examples including the $C_8-C_{16}$ alkyl ethers of dicyclopentenol.

The detergent composition also contains a solid phase which is homogeneously dispersed in the liquid phase and which contains other detergent constituents having a cleaning effect and, optionally, auxiliaries. These other detergent constituents with their cleaning effect include primarily washing alkali metal salts and sequestering compounds. Anionic surfactants, particularly selected from the group consisting of sulfonate surfactants and soaps, may also be present.

The preferred washing alkali metal salt is sodium metasilicate having the composition $Na_2O:SiO_2=1:0.8$ to 1:1.3 and preferably 1:1, which is used in anhydrous form. In addition to the metasilicate, anhydrous soda is also suitable although it does require larger proportions of liquid phase on account of absorption properties and is therefore less preferred. The metasilicate content of the detergent may be 35 to 70% by weight, preferably 40 to 65% by weight, and more preferably 45 to 55% by weight, while the soda content is 0 to 20% by weight and preferably 0 to 10% by weight, based on the weight of the detergent composition.

Suitable sequestering agents include those selected from the group consisting of aminopolycarboxylic acids and polyphosphonic acids. The aminopolycarboxylic acids include nitrilotriacetic acid, ethylenediaminetetraacetic acid, diethylenetriaminepentaacetic acid and higher homologs thereof. Suitable polyphosphonic acids include 1-hydroxyethane-1,1-diphosphonic acid, aminotri-(methylenephosphonic acid), ethylenediaminetetra(methylenephosphonic acid) and higher homologs thereof, such as for example diethylenetriaminetetra-(methylenephosphonic acid). The polycarboxylic acids and polyphosphonic acids mentioned are normally used in the form of their sodium or potassium salts. Sodium nitrilotriacetate is preferred, being used in a quantity of less than 10% by weight, and preferably in a quantity of 2 to 6% by weight, based on the weight of the detergent composition.

Other suitable sequestering agents include polycarboxylic acids and hydroxypolycarboxylic acids in the form of their alkali metal salts, for example sodium citrate and sodium gluconate.

Preferred sequestering agents include homopolymeric and/or copolymeric carboxylic acids or sodium or potassium salts thereof, preferably the sodium salts. Suitable homopolymers include polyacrylic acid, polymethacrylic acid and polymaleic acid. Suitable copolymers include those of acrylic acid with methacrylic acid, or copolymers of acrylic acid, methacrylic acid or maleic acid with vinyl ethers, such as vinyl methyl ether or vinyl ethyl ether, and with vinyl esters, such as vinyl acetate or vinyl propionate, acrylamide, methacrylamide and with ethylene, propylene or styrene. In the interests of adequate solubility in water, their content in those copolymeric acids in which one of the components does not have an acid function is less than 70 mol percent and preferably less than 60 mol percent. Copolymers of acrylic acid or methacrylic acid with maleic acid, of the type described for example in European Patent 25 551-B1, are particularly suitable. The copolymers in question are copolymers containing 50 to 90% by weight acrylic acid or methacrylic acid and 50 to 10% by weight maleic acid. Particularly preferred copolymers are those containing 60 to 85% by weight acrylic acid and 40 to 15% by weight maleic acid.

It is also possible to use polyacetalcarboxylic acids of the type described for example in U.S. Pat. Nos. 4,144,226 and 4,146,495 which are obtained by polymerization of esters of glycolic acid, introduction of stable terminal groups and hydrolysis to the sodium or potassium salts. Polymeric acids obtained by polymerization of acrolein and disproportionation of the polymer by Canizzaro reaction using strong alkali metal salts are also suitable. They consist essentially of acrylic acid units and vinyl alcohol units or acrolein units.

The molecular weight of the homopolymers or copolymers is generally from 500 to 120,000 and preferably 1,500 to 100,000.

The detergents contain from 0 to 10% by weight, preferably from 1 to 7.5% by weight, and more preferably from 2 to 5% by weight of carboxyl-containing polyacids or polymeric acids, and from 0 to 3% by weight, preferably from 0.05 to 1.5% by weight and more preferably from 0.1 to 1% by weight of polyphosphonic acids, based on the weight of the detergent composition. They are used in anhydrous form.

The detergent pastes are preferably free from phosphates. Where the presence of phosphate is ecologically acceptable (as for example in a phosphate-eliminating wastewater treatment), polymeric phosphates, such as sodium tripolyphosphate (STP), may be present. They may be present in a quantity of less than 20% by weight, based on the detergent, the proportion of other solids, for example sodium silicate, being reduced accordingly. STP may be present in a quantity of preferably less than 15% by weight and more preferably in a quantity of less than 10% by weight.

Other sequestering agents suitable for the purposes of the invention include finely-divided zeolites of the NaA type which have a calcium binding power of 100 to 200 mg CaO/g (as defined in German Patent No. 12 24 837). Their particle size is normally in the range of from 1 to 10 μm. They are used in dry form. The water present in bound form in the zeolites is not troublesome in the present case. The zeolite content is from 0 to 20% by weight and preferably from 0 to 10% by weight.

Other additives having a cleaning effect, which may be incorporated in the detergent in solid, finely particulate, substantially anhydrous form, include anionic surfactants, particularly sulfonates and fatty acid soaps which are both preferably present as sodium salts. Suitable anionic surfactants include alkyl benzenesulfonates having a linear $C_9$–$C_{13}$ alkyl chain, particularly dodecyl benzenesulfonate, linear alkane sulfonates containing 11 15 carbon atoms of the type obtained by sulfochlorination or sulfoxidation of alkanes and subsequent saponification or neutralization, α-sulfofatty acid salts and their esters derived from $C_{12}$–$C_{18}$ fatty acids and lower alcohols, such as methanol, ethanol and propanol, and olefin sulfonates of the type obtained, for example, by $SO_3$ sulfonation of terminal $C_{12}$–$C_{18}$ olefins and subsequent alkaline hydrolysis. Preferred surfactants are alkyl benzenesulfonates. Suitable soaps include those of saturated or unsaturated $C_{12}$–$C_{18}$ fatty acids, for example soaps obtained from coconut, palm kernel or tallow fatty acids. In the interests of low foam generation when the detergents are in use, the content of sulfonate surfactants should not exceed 4% by weight, based on the detergent, and is preferably from 0.5 to 2.5% by weight of sodium dodecyl benzenesulfonate. An addition of sulfonate surfactant not only increase detergency, it also improves the stability of the paste against sedimentation and makes the paste easier to disperse in water. Surprisingly, it has also been found that the sulfonate surfactant is largely distributed in the liquid phase and improves the solid/liquid balance in favor of the liquid phase. Accordingly, pastes containing sulfonate surfactants are able to take up relatively large quantities of solids and the proportion of nonionic surfactant may be reduced accordingly without any significant increase in viscosity.

An addition of soap of less than 1% by weight, preferably less than 0.5% by weight and more preferably of 0.1 to 0.3% by weight, based on the detergent, also increases the suspension stability of the paste. The addition of soap also reduces the tendency of the detergents to foam and improves their detergency. Additions of more than 1 to 2% by weight can cause the paste to solidify and should therefore be avoided.

Washing aids are other suitable constituents which, again, may mainly be part of the solid phase. They include redeposition inhibitors, optical brighteners, foam inhibitors, bleaches and dyes. Where perfumes which are generally liquid are used, they mostly pass over into the liquid phase. By virtue of the minimal quantity in which they are used, however, they have no significant effect on the flow behavior of the pastes.

Suitable redeposition inhibitors include cellulose ethers, such as carboxymethyl cellulose, methyl cellulose, hydroxyalkyl celluloses and mixed ethers, such as methylhydroxyethyl cellulose, methylhydroxyproply cellulose and methylcarboxymethyl cellulose. Sodium carboxymethyl cellulose and mixtures thereof with methyl cellulose are preferably used. The content of redeposition inhibitor is generally from 0.2 to 2% by weight and preferably from 0.5 to 1.5% by weight.

Optical brighteners for fabrics of cellulose fibers (cotton) include, in particular, derivatives of diaminostilbene disulfonic acid or alkali metal salts thereof, such as for example salts of 4,4'-bis-(2-anilino-4-morpholino-1,3,5-triazin-6-ylamino)-stilbene-2,2'disulfonic acid or compounds of similar structure which, instead of the morpholino group, contain a diethanolamino group, a methylamino group or a 2-methoxyethylamino group. Brighteners of the substituted 4,4'-distyryl diphenyl type, for example the compound 4,4'-bis-(4-chloro-3-sulfostyryl)-diphenyl, may also be present. Mixtures of brighteners may also be used. Brighteners of the 1,3-diaryl-2-pyrazoline type, for example the compound 1-(p-sulfamoylphenyl)-3-(p-chlorophenyl)-2-pyrazoline, and compounds of similar structure are suitable for polyamide fibers. The content of optical brightener or brightener mixture in the detergent is generally from 0.01 to 1% by weight and preferably from 0.05 to 0.5% by weight.

Suitable foam inhibitors include known polysiloxane/silica mixtures in which the finely particulate silica is preferably silanized. The polysiloxanes may consist both of linear compounds and of crosslinked polysiloxane resins and mixtures thereof. Other suitable foam inhibitors include paraffin hydrocarbons, including the paraffin oils already mentioned, but also microparaffins and paraffin waxes having melting points above 40° C. Other suitable foam inhibitors are saturated fatty acids or soaps containing 18 to 24 and preferably 20 to 22 carbon atoms, for example sodium behenate. The additional foam inhibitors, i.e., besides the paraffin oil, may be present in a quantity of less than 2% by weight and preferably in a quantity of less than 1% by weight and, in the case of the soaps, correspondingly less. In many cases, however, the tendency towards foaming may be reduced by a suitable choice of the nonionic surfactants, so that there is no need for foam inhibitors.

Bleaches may be present as another constituent of the solid phase. Suitable bleaches include per compounds, such as sodium perborate monohydrate, caroates ($KHSO_5$) and organic per acids, such as perbenzoates or peroxyphthalates. These per compounds are stable in storage in the detergents of this invention by virtue of the substantial absence of water. Known bleach activators may also be present, hydrolyzing with the per compounds on addition of water to form per acids. Such bleach activators include, for example, tetraacetyl ethylenediamine or phthalic anhydride. However, since in institutional laundries the bleach component is normally added directly to the wash liquor and, in general, is only used when really necessary, there is generally no need for bleaches in paste.

The constituents present in the solid phase should be finely divided with an average particle size of 5 to 40 μm, less than 5% of the particles having a particle size of greater than 80 μm. The average particle size is preferably 10 to 30 μm, and more preferably 10 to 20 μm, the maximum particle size preferably being less than 50 μm and more preferably less than 40 μm. The average particle size is based on volume distribution as determined by known methods (for example Coulter Counter).

The viscosity of the pastes is generally in the range from 20 Pa.s to 1,000 Pa.s (Pascal . sec), as measured at 20° C. using a Brookfield viscosimeter (spindle No. 6, 10 revolutions per minute). The preferred viscosity range is from 30 to 300 Pa.s and more preferably from 50 to 150 Pa.s. The pastes are generally thixotropic. At room temperature, their viscosity is so high in the absence of shear forces that, under the sole influence of gravity, they do not flow out from the storage container or a measuring cup either at all or in a reasonable time. In this regard they differ basically from known anhydrous, pourable liquid concentrates, for example those according to European Patent 30 096, in which the proportion of liquid nonionic surfactants or organic solvents is considerably higher.

To prepare the paste-form detergents, the liquid constituents, which are best heated to a temperature of from 40° C. to 60° C., are premixed with the solids already present in powder form. The premix is then ground to the particle size specified for the solid phase in a grinding unit, for example a colloid mill, and homogenized, excessive heating of the product being avoided by suitable cooling of the unit. If necessary, the homogenized paste is degassed in vacuo in a deaeration unit. Heat-sensitive constituents and constituents for the final regulation of viscosity, such as perfumes, dyes, organic per compounds, layer silicates and soaps, may then be added. The final paste may then be directly packed in containers.

BRIEF DESCRIPTION OF THE DRAWINGS

FIG. I is a schematic illustration of the basic elements of the dosing system.

FIG. II illustrates an embodiment wherein the paste detergent is removed from an open container.

Figure 1:
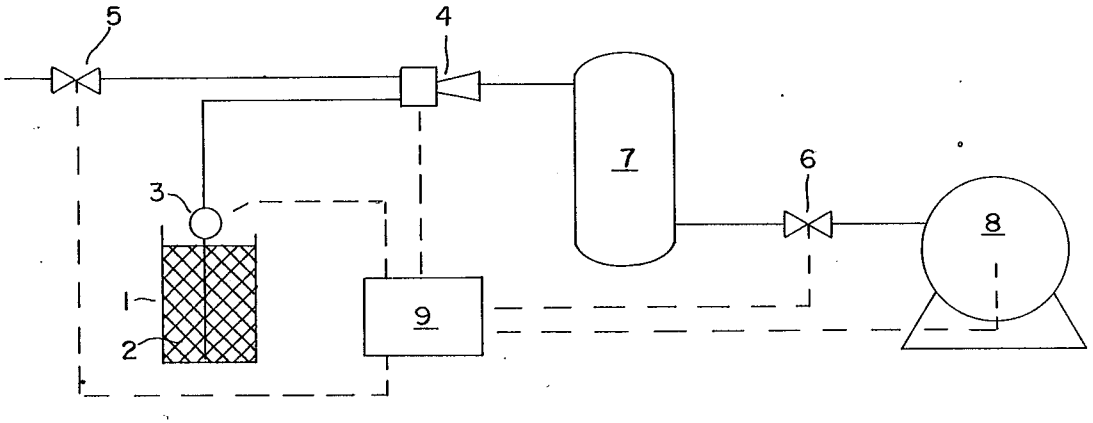
Figure 4:
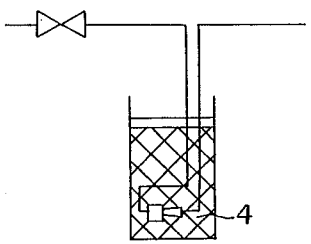
Figure 3:
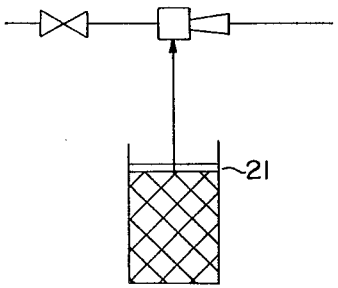
Figure 2:
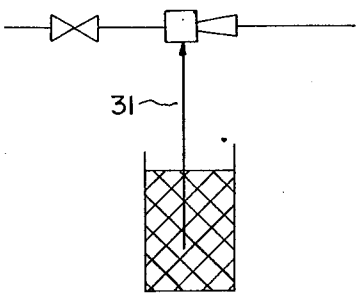
Figure 6:
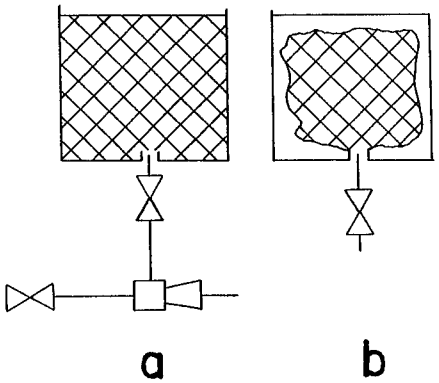
Figure 5:
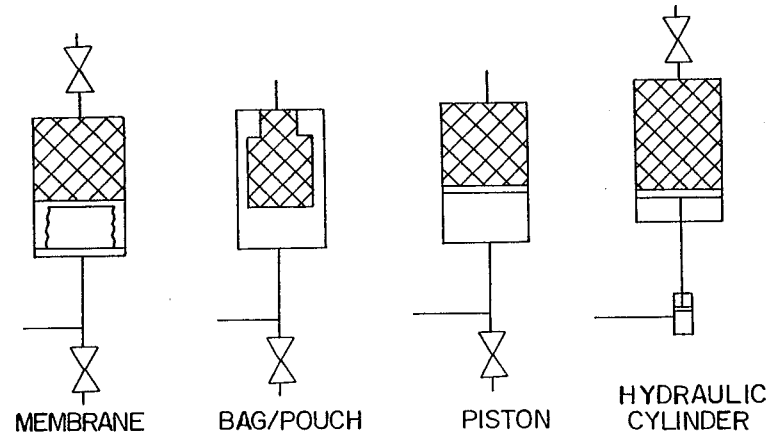
Figure 7:
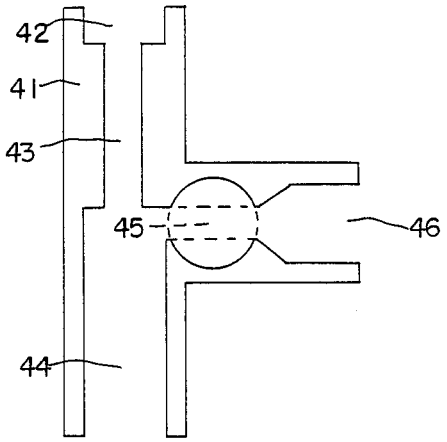
Figure 8:
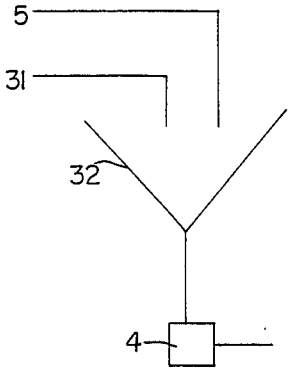

FIG. III illustrates an embodiment wherein the paste detergent container is equipped with a movable, tightly closing follower plate.

FIG. IV illustrates an embodiment wherein the paste detergent container is equipped with a mixer.

FIG. V illustrates an embodiment wherein the paste detergent is removed from a container under the effect of pressure.

FIG. VI illustrates an embodiment wherein the paste detergent is guided downwardly by various means.

FIG. VII illustrates a shut-off member denying entry of water to a paste detergent intake pipe.

FIG. VIII illustrates another embodiment wherein entry of feed water is denied from entry into the paste detergent intake pipe.

DETAILED DESCRIPTION OF THE DRAWINGS

As shown in FIG. I, the dosing system consists essentially of the following basic elements: a storage container 1 for the detergent paste 2, means 3 for removing and transporting the paste, a mixer 4 for mixing the paste with water taken from a supply 5, a feed line 6, which is fitted with dosing valves and is optionally connected to an intermediate container or equalizing container 7, to the point of use such as a washing machine 8, and a control unit 9 which records the demand for detergent or wash liquor at the point of use and controls the functions of elements 3, 4 and 5, including dosage of the water supply from feed line 6 and the removal from container 7, in dependence upon demand. The control lines are shown in chain lines while the main pulse directions are marked by arrows.

The storage container 1 is preferably identical with the intermediate container 7 in which the paste is supplied, but it may have any shape. Suitable examples include casks, barrels or cartridges of metal or plastics materials or even film packs, for example sacks or bags, which may be packed in cardboard boxes. Preferred containers have rigid outer walls and a circular or square cross-section because this facilitates removal of the paste.

The paste removal means 3 is intended to ensure complete emptying of the storage container 1 and is adapted in its function and configuration to the function of the storage container and the mixer 4. It may consist of a simple pipe which connects the storage container to the mixer. However, it may also contain additional elements which guide and regulate the product. FIGS. II to VI show examples of such embodiments, although the invention is by no means limited to these examples.

FIG. II shows an embodiment wherein the paste is taken from an open container. The removal pipe 31 extends to the bottom of the container 1. The mixer 4, which may consist of an injector and which generates a reduced pressure in the removal pipe, takes in the paste and mixes it with water supplied via the pipe system 5. However, the mixer 4 may also consist of a motor-driven pump which takes in the paste through the removal pipe 3 and mixes it with the inflowing water on the pressure side, for example by means of a nozzle.

FIG. III shows an embodiment wherein the container is equipped with a movable, tightly closing follower plate 21. By its weight, this follower plate exerts an additional pressure on the surface of the paste and causes the surface of the paste to be uniformly lowered, residues of paste being stripped off the inner wall of the container and the thixotropic paste being partly liquefied and more readily transported. In this case, the product may be removed from underneath of the follower plate. The follower plate may also be driven by a motor or by a piston, its advance being controlled by the control unit 9. In this way, the paste material may be forced into the removal pipe 31 and transported to the mixer.

FIG. IV shows an embodiment wherein the mixer 4 dips into the storage container 1 and directly removes the paste therefrom.

FIG. V shows embodiments wherein the paste is transported under the effect of pressure. This pressure may be applied, for example, hydraulically or pneumatically to a membrane a, a flexible inner container (bag) b, a piston c, or a hydraulic cylinder d. The piston may be advanced by a toothed rack, a threaded spindle or an eccentric shaft. An embodiment such as this and also the embodiment with the hydraulic cylinder provides both for controlled advance and hence for exact dosing of the paste at this point.

FIG. VI shows embodiments with downward guiding of the paste product. In the left-hand embodiment a, the storage container consists of a cartridge which is closed at its upper end by a movable plate. This plate may be weighted or may be equipped with a pressure applicator as shown in FIG. V. The right-hand embodiment b consists of a container in which the paste is accommodated in an inner bag of plastic. The bag shrinks as emptying progresses, the uniformity of the emptying process again being facilitated by a follower plate to which pressure is applied or which may be designed to advance under control. An embodiment such as this is also suitable for a cartridge pack with an inner bag as the storage container. The paste may be transported to the mixer 4 either by a feed pump 3 or by the pressure applied to the paste (cf. the embodiments shown in FIG. V) or by the reduced pressure generated by the mixer 4 or even by a suitable combination of these measures. Transport under reduced pressure is possible, for example, in an embodiment in which the mixer 4 consists of an injector which works on the principle of a water jet pump. In this case, the mixing ratio is controlled by means of suitable throttle devices or dosing valves arranged in the water supply 5 or the removal means 31. However, the mixer 4 may also consist of a motor-driven propeller mixer or similarly acting mechanical mixer. In this case, the paste is dosed via arrangements with controlled paste transport, for example by means of a feed pump or an embodiment of the type shown in FIG V or VI, and controlled supply of water through the pipe system 5.

It has proved to be of advantage to integrate an additional shut-off member in the mixer, particularly where it consists of an injector operating on the principle of a water jet pump. This shut-off member is intended to prevent the feed water from coming into contact with the paste delivered during the rest phases. This is because it has been found that, in the event of prolonged rest phases, the paste in the course of delivery reacts with the water remaining in the injector. As a result, crust-like deposits can be formed in the contact area, adversely affecting the efficiency of the injector. Similar problems can arise when a high counter-pressure builds up briefly in long dosing lines to the points of use. The effect of this counter-pressure is that water delivered is forced into the paste intake pipe and, in some cases, into the vicinity of the storage container. As a result, the paste can solidify to such an extent that it can no longer be transported.

A controllable or automatically closing shut-off member integrated into the mixer or into the injector avoids these possible disadvantages. This shut-off member may consist for example of a shut-off ball valve which stops the entry of water into the paste feed line when the installation is in the rest phase or when a counter-pressure builds up in the injector. The valve releases the feed line when a sufficiently large reduced pressure has built up in the paste feedline. The valve may be controlled by the counter-pressure of an adjustable spring. Preferably, the valve is also opened and closed through control unit 9. In this case, the shut-off member may consist, for example, of a rotatable shut-off cock which is driven by a motor and of which the position follows the particular pressure conditions prevailing.

FIG. VII shows one example of this embodiment. The water enters an injector 41 under high pressure through an inlet 42, passes through a cross-sectional constriction 43 and leaves the injector through a widened outlet 44. A rotatable shut-off member 45 is laterally arranged in the zone of widened cross-section where a reduced pressure builds up, being shown in its open position in the drawing. By rotation through 90°, the opening is closed, denying the water access to a paste intake pipe 46.

Another embodiment of the mixer, by which the feed water can be effectively prevented from entering the paste feed pipe, is shown in FIG. VIII. The paste feed pipe 31 coming from the pump 3 and the water feed pipe 5 open into a vertical funnel 32 open at its upper end, of which the outlet leads to the mixer 4. By installing nozzles or by a corresponding, for example tangential arrangement of the outflow opening, the water supply can be designed in such a way that paste and water are premixed and the paste is prevented from collecting on the funnel wall. By installing sensors which record the filling level of the funnel, the function of the funnel can be monitored and, for example, the supply interrupted in the event of delay or interruption in feed as a result of back pressure or functional problems. The same effect can also be produced by an overflow system which takes up the overflowing amounts of paste and feed water and, after elimination of the fault, delivers its contents to the mixer.

In the mixer, the paste is diluted to at least such an extent that a gel phase is avoided. In a gel phase, the nonionic surfactants and the undissolved or only partly dissolved salts form a highly viscous, tough gel which disperses and dissolves very poorly or relatively slowly in water. Accordingly, a sufficient quantity of water is added to the paste in the mixer so that this intermediate gel phase cannot develop. 0.5 to 1.5 times the quantity of water to that of paste is generally sufficient for this purpose. The paste may of course be more highly diluted, for example to the concentration of the ready-to-use liquor. In general, however, the paste is not diluted as highly as this, particularly if several machines are to be synchronously operated with one dispenser. Accordingly, it is preferred to add only such a quantity of water that a readily transported and readily dosed concentrate is formed and is subsequently diluted to the desired liquor concentration at the point of use, i.e., in the washing machine. Suitable dilution ratios of paste to water are 2:1 to 1:10 and preferably 3:2 to 1:3.

A conductivity sensor may be installed after the mixer, recording the conductivity and hence the concentration of the detergent solution. The operation of the feed and dosing system may thus be effectively monitored and interrupted in the event of faults. This applies in particular to cases where the supply of paste is interrupted or is non-existent through emptying of the storage container or where there is a fault in the water supply.

The aqueous concentrate may be directly fed to the individual washing machines through corresponding distributors controlled as a function of consumption. However, where several machines are to be operated simultaneously or in synchronism, it may be advisable to arrange an intermediate container or equalizing container 7 between the mixer and the point of use so that an adequate supply of aqueous detergent concentrate is always available in the event of intermittent operation. To prevent possible sedimentation of incompletely dissolved constituents of the concentrate, particularly during rest periods or intervals, the equalizing container is preferably equipped with a mixer or stirrer. In addition, the pipe system may be in the form of a ring pipe and the equalizing container included in this system. IN this ring pipe, the concentrate is constantly pump-circulated and only the particular quantity required is fed to or taken from it. This circulation of the concentrate effectively prevents possible sedimentation of undissolved or crystallizing constituents and blockage of the pipe system or dosing valves.

There is not need for an equalizing container if the individual dosing elements, i.e., the removal means 3, the mixer 4, the water supply valve 5 and the feed line dosing valves 6, to the points of removal are synchronously controlled. Any pressure variations in the pipe system can be detected by a pressure sensor and equalized by corresponding control of the pumps and valves. Where several washing machines are operated simultaneously, the cycle times follow one another at such short intervals that no undesirable sedimentation can occur.

The concentrate is fed into the washing machine through the dosing valve 6 which, like the dosing and mixing means already described, is controlled by the process control unit 9 such as a computer. An optimal washing result and optimal utilization of the detergent can be obtained by consumption-based control. In this case, the electrical conductivity of the wash liquor has been successfully used as a control quantity, being determined and monitored by a measuring cell arranged in the washing machine. Not only is it possible in this way precisely to establish the desired initial concentration , it is also possible to follow the consumption of washing-active substance through its adsorption onto the soil particles which is generally accompanied by a reduction in conductivity. In the event of relatively large accumulations of soil, more washing-active concentrate can be automatically added. On the other hand, in the washing of only lightly soiled linen, for example hotel bed linen which has only been used once, it is possible to save detergent concentrate and to avoid unnecessary overconsumption by the consumption-based dosing.

Instead of conductivity measurement, other methods, including for example nephelometric control of the wash liquor, may also be used.

The concentration of the wash liquor is in the range from 0.5 to 10 g/l. It is dependent on the degree of soiling of the laundry, i.e., with only lightly soiled laundry, the in-use concentration is generally in the range from 0.5 to 5 g/l while, for heavily soiled washing, it is in the range from 5 to 10 g/l. In special cases, for example with heavily soiled working apparel, the concentration may be even higher, amounting for example to 12 g/l. In general, it is in the range from 2 to 8 g/l. The liquor ratio (kg fabrics per liter wash liquor) is generally 1:2 to 1:10 and preferably 1:4 to 1:6. Softened (permutit-treated) water is normally used, softened water also generally being used for the final rinse, at least for the first final-rinse cycle. Basically, the washing process in the machine is not significantly different from conventional procedures except for the fact that, as explained above, more detergent can always be automatically added in the event of increased demand through heavy soiling.

EXAMPLE I

A detergent mixture (200 kg) was prepared containing the following anhydrous constituents (in % by weight):

24.0% nonionic surfactant
2.0% Na dodecyl benzenesulfonate
8.5% Na nitrilotriacetate
55.0% Na metasilicate (1:1)
8.5% pentasodium triphosphate
1.5% cellulose ether
0.5% optical brightener The nonionic surfactant used was a mixture of saturated $C_{12}$–$C_{14}$ fatty alcohol+3 EO and $C_{12}$–$C_{14}$ fatty alcohol+5 EO in a ratio by weight of 1:1, solidification point 5° C.

The mixture was ground for 30 minutes in a mill (SZEGO-1 colloid mill). The ground product (exit temperature 45° C.) had an average particle size of 18.6 μm and a viscosity of 50 Pa.s (Brookfield 6/10 at 20° C.). 0.1% of a dye was added in a cooled paste mixer having a wall stripper. The end product was a storable, pumpable paste having specific gravity of 1.7 g/ml.

The paste was packed in casks (capacity 50 and 200 l) which could be directly connected to the dispensing system described above. Mixing with water in a ratio of 1:1 produced a thinly liquid, readily dispensable and readily water-dilutable concentrate (low-foam stock liquor). The diluted concentrate was intermediately stored in a storage container (with level-dependent feeding) and fed from there to the washing machines. The feed lines were in the form of ring pipes in which the concentrate was pump-circulated. There was no sedimentation of detergent constituents.

EXAMPLE II

Example I was repeated using 57% by weight sodium metasilicate and 22% by weight of a nonionic surfactant mixture comprising 2 parts by weight $C_9$–$C_{11}$ oxo alcohol containing 5 EO and 1 part by weight $C_{12}$–$C_{13}$ oxo alcohol containing 6 EO. The average particle size of the ground material was 16.5 μm and the viscosity was 54 Pa.s (Brookfield 16/20 at 20° C.). This mixture was also storable, pumpable and dispensable and, after dilution with water (1:1 to 1:3), provided thinly liquid, low-foam concentrates having comparable properties.

EXAMPLE III

Example I was repeated, 0.2% by weight of the nonionic surfactant being replaced by the same quantity of a sodium tallow soap. The viscosity of the paste increased to 68 Pa.s. The aqueous liquor showed a particularly low tendency towards foaming.

EXAMPLE IV

A paste was prepared from the following constituents (in % by weight):

17.5% $C_{13}$ oxo alcohol+3 EO
2.5% $C_{13}$ oxo alcohol+6 EO
2.0% Na dodecyl benzenesulfonate
8.0% polyethylene glycol (MW 400)
7.5% acrylic acid/maleic acid (3:1) copolymer (MW 70,000) present as sodium salt
2.5% ethylenediaminetetra-(metylenephosphonate), $Na_6$ salt
5.0% Na nitrilotriacetate
52.5% Na metasilicate
2.0% cellulose ether
0.3% optical brightener
0.2% Na tallow soap The abbreviation MW stands for molecular weight. The constituents were processed to a homogeneous, stable paste in the same way as in Example I. The average particle size was 17.0 μm with no particles larger than 40 μm. The viscosity was 76 Pa.s (Brookfield 6/10) at 20° C. The paste corresponded in its performance properties to the detergent of Example I with even less foaming, particularly during the final rinse phase.

EXAMPLE V

Compared with Example IV, the polyethylene glycol ether was replaced by a 1:1 mixture of paraffin oil and a lauryl ether of dicyclopentenol. The energy required to grind the paste was about 20% lower than in Example IV. The viscosity was 74 Pa.s. In addition the tendency of the paste to foam after dilution to the in-use concentration was even lower than in Example IV.

EXAMPLE VI

This mixture contained the following liquid constituents (in % by weight):

22% oleyl alcohol/cetyl alcohol (1:1)+1.5 PO+6 EO, and 6% polyethylene glycol 400.

The composition of the solids, including Na dodecyl benzenesulfonate, was as in Example IV. The paste ground to an average particle size of 18.2 μm and having a viscosity of 82 Pa.s was stable in storage and readily transportable. Its foaming tendency after dilution to the in-use concentration was minimal. In addition, the detergent was distinguished by the fact that it could be rinsed out more easily in the final rinse.

EXAMPLE VII

The pastes prepared in accordance with the preceding examples were packed and stored in metal casks (capacity 200 l). The paste was removed by way of a suction pipe which opened centrally into a follower plate (21) as shown in FIG. III. The paste was delivered by a feed pump to a centrifugal pump in which it was mixed with softened water flowing in by way of a dosing valve (5) in a ratio of 1:1. The mixture was fed into the washing machines (10-machine line) by way of a central pipe with valve-controlled feed lines to the individual machines. Control was effected in dependence upon the conductivity of the dilute wash liquor in the washing machines and was carried out in such a way that the removal pump, the mixer, the feed valve for the softened water and the particular dosing valves on the individual washing machines operated in synchronism. This control system was monitored by an additional pressure sensor in the pipe system and a constant, slight excess pressure maintained. This eliminated the need for an equalizing container. No solid constituents of the dilute paste were sedimented in the usual cycle times. After prolonged rest periods, for example overnight, the pipe system was flushed through as a precautionary measure by way of a return pipe. The installation operated without interruption over the half-year test period.

We claim:

1. A machine washing process with process-controlled dosing of water and detergent, comprising:

a. a paste-form, phosphate-reduced or phosphate-free detergent composition which is substantially free from water, organic solvent selected from the group consisting of low molecular weight, low-boiling alcohols and ether alcohols and hydrotropic compound, comprising a phase which is liquid at a temperature below 10° C. and containing a nonionic surfactant selected from the group consisting of alkoxylated alcohols and ethoxylated alkylphenols, and a solid phase dispersed therein wherein the particles have a mean particle size of about 5 to about 40 μm and less than about 5% of the particles have a particle size of greater than about 80 μm, the solid phase comprising a washing alkali, sequestering compound and other detergent constituents; and, b. a process controlled system for dosing said detergent composition into the liquor container of a washing machine, said system removing said detergent composition from a storage container and delivering it to a mixer wherein it is diluted with water to at least such an extent that the formation of a gel phase is avoided, feeding the aqueous detergent mixture to said washing machine, and diluting the aqueous detergent mixture with more water to a concentration of 0.5 to 10 g/l.

2. A process as in claim 1 wherein the content of nonionic surfactant in the paste-form detergent is from about 15 to about 30% by weight, based on the weight of said detergent.

3. A process as in claim 1 wherein said paste-form detergent contains a low-melting mixture of nonionic surfactants differing in their degrees of ethoxylation.

4. A process as in claim 1 wherein the liquid phase of said paste-form detergent contains less than about 15% by weight of a compound selected from the group consisting of a low molecular weight polyethylene glycol, paraffin oil and liquid ether containing 8 to 16 carbon atoms in the hydrocarbon chain, based on the weight of said detergent.

5. A process as in claim 1 wherein said paste-form detergent contains less than about 4% by weight of a sulfonate surfactant selected from the group consisting of $C_{10}$–$C_{13}$ alkyl benzenesulfonate, $C_{11}$–$C_{15}$ alkanesulfonate, $C_{12}$–$C_{18}$ $\alpha$-olefin sulfonate, $\alpha$-sulfofatty acid and esters thereof and less than about 1% by weight of a $C_{12}$–$C_{18}$ soap, based on the weight of said detergent.

6. A process as in claim 1 wherein said detergent contains sodium metasilicate in a quantity of from about 35 to about 70% by weight, based on the weight of said detergent.

7. A process as in claim 1 wherein the average particle size of the constituents present in the dispersed solid phase is between about 5 and about 40 $\mu$m, and the maximum size of the particles is less than about 80 $\mu$m.

8. A process as in claim 1 wherein the Brookfield viscosity measured at 20° C. using a No. 6 spindle at about 10 revolutions per minute of the paste-form detergent is from about 20 to about 1,000 Pa.s.

9. A process as i claim 1 wherein said nonionic surfactant has a melting temperature of less than about 10° C.

10. A process as in claim 1 wherein said controlled system for dosing comprises: a storage container for the detergent paste, means connected to said storage container for removing and transporting the paste, a mixer connected to said means for removing and transporting the paste for mixing the paste with water taken from a water supply, a feed line connected to said mixer and to the point of use of the detergent, and a control unit which records the demand for detergent or wash liquor at the point of use and controls the functions of said means for removing and transporting the paste, said mixer, and said water supply, including dosage of the water supply from said feed line, in dependence upon demand.

11. A process as in claim 10 wherein said paste is diluted with softened water in ratio of 2:1 to 1:10 in said mixer.

12. A process as in claim 10 wherein the dosing system additionally comprises an equalizing container connected to said mixer and said feed line.

13. A process as in claim 10 wherein the function of said means for removing and transporting the paste, said mixer, said water supply and said feed line is synchronously controlled in dependence upon the conductivity of the dilute wash liquor as measured in the point of use.

14. A process as in claim 13 wherein said point of use comprises a washing machine.

15. A process as in claim 10 wherein said means for removing and transporting said paste extends to the bottom of said storage container.

16. A process as in claim 10 wherein said mixer comprises an injector which generates a reduced pressure.

17. A process as in claim 10 wherein said mixer comprises a motor-driven pump.

18. A process as in claim 10 wherein said storage container is equipped with a movable, tightly closing follower plate.

19. A process as in claim 10 wherein said mixer is positioned into said storage container.

20. A process as in claim 10 wherein said paste is transported from said storage container under the effect of pressure.

21. A process as in claim 10 wherein said mixer is equipped with a shut-off member.

* * * * *